United States Patent [19]

Gordon et al.

[11] Patent Number: 4,964,173

[45] Date of Patent: Oct. 23, 1990

[54] DIGNITY GOWNS

[76] Inventors: David G. Gordon, 113 Laredo Ave., New Lebanon, Ohio 45345; Carol A. Winkler, 8722 Dayton-Oxford, Franklin, Ohio 45005

[21] Appl. No.: 366,649

[22] Filed: Jun. 14, 1989

[51] Int. Cl.[5] ..... A41B 9/00; A41D 10/00

[52] U.S. Cl. ..... 2/114; 2/73; 2/74

[58] Field of Search ..... 2/71, 72, 73, 74, 114, 2/DIG. 7

[56] References Cited

U.S. PATENT DOCUMENTS

| | | | |
|---|---|---|---|
| 1,823,257 | 9/1931 | Cooper | 2/74 |
| 1,848,040 | 3/1932 | Ash | 2/74 |
| 2,439,128 | 4/1948 | De'Oliensis | 2/74 |
| 2,818,573 | 1/1958 | O'Donnell | 2/DIG. 7 X |
| 3,339,209 | 9/1967 | Larson | 2/114 X |
| 3,490,072 | 1/1970 | Keltner | 2/114 |
| 4,422,186 | 12/1983 | Loney | 2/114 |
| 4,570,268 | 2/1986 | Freeman | 2/114 |
| 4,578,825 | 4/1986 | Vote | 2/DIG. 7 X |
| 4,622,699 | 11/1986 | Spriggs | 2/DIG. 7 X |
| 4,677,697 | 7/1987 | Hayes | 2/159 |
| 4,759,083 | 7/1988 | Belcher | 2/114 |
| 4,837,863 | 6/1989 | Van Scoy-Mosher | 2/DIG. 7 X |

OTHER PUBLICATIONS

Bramley, Sheelagh, "Gowns—Practical and Pretty", Nursing Times, Jun. 4, 1965, pp. 780–781.

*Primary Examiner*—Werner H. Schroeder
*Assistant Examiner*—Jeanette E. Chapman
*Attorney, Agent, or Firm*—Robert W. Becker & Associates

[57] ABSTRACT

A dignity gown having a minimum number of parts including a fully closed back portion as well as overlapping lower front portion and a top front portion that is capable of being detached temporarily via fastening means devoid any snap fasteners at all and provided as hook-loop fasteners known by the name "VELCRO TM" as well plastic breakaway zipper means and adhesive strips to assure keeping the back side closed for warmth of a patient or individual although permitting medical examination and treatment to occur via the areas of the fastening means subject to being released or opened for limited access to upper body areas and/or lower body areas as necessary as opposed to whole body exposure previously encountered with hospital gowns.

10 Claims, 3 Drawing Sheets

FIG-1
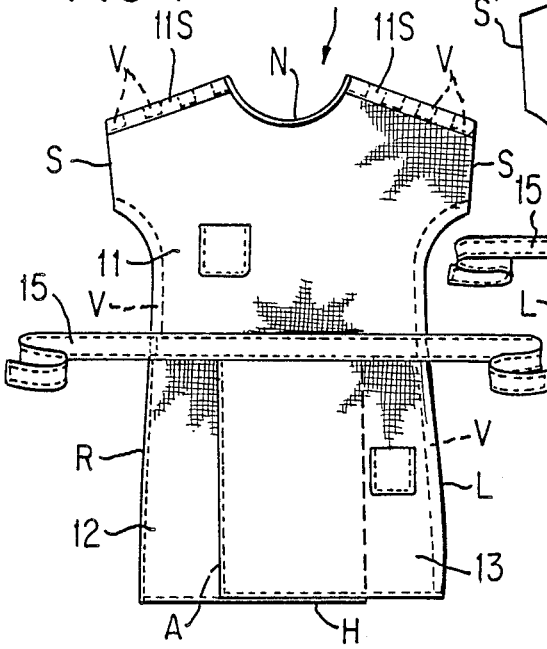
FIG-2
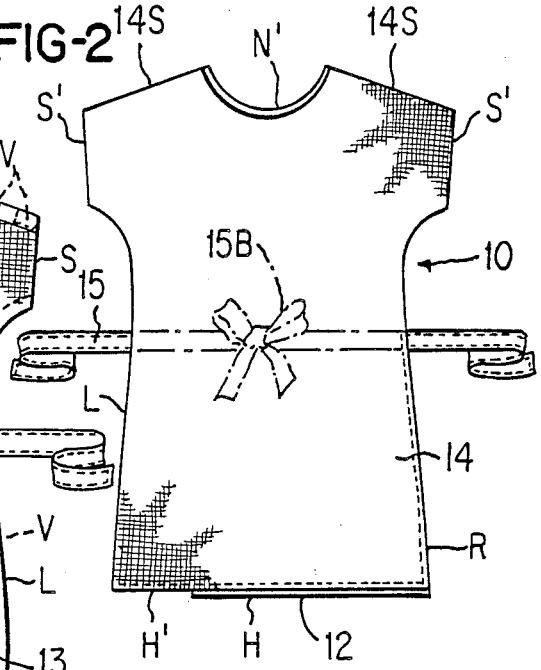
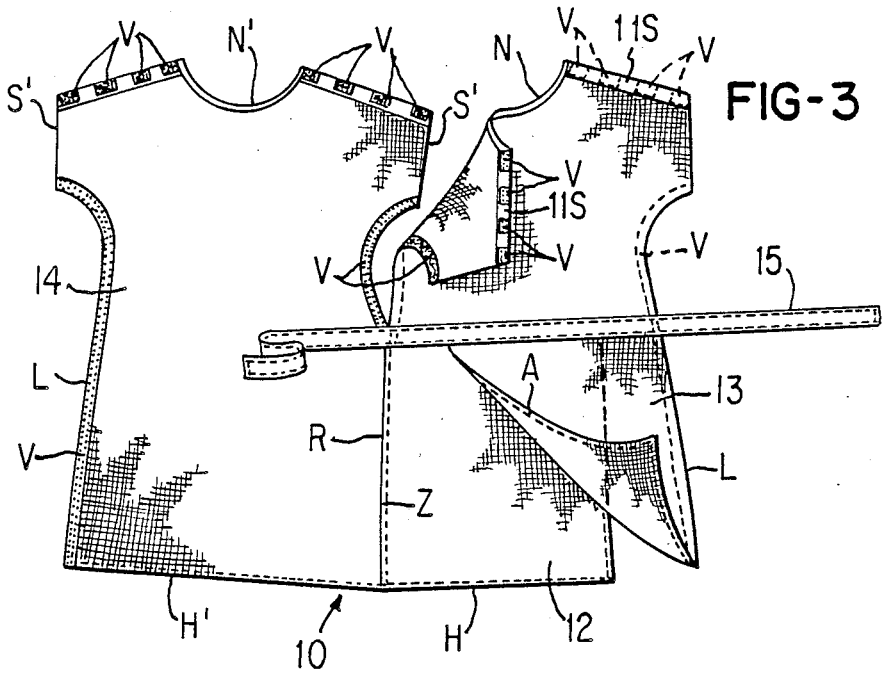
FIG-3

DIGNITY GOWNS

The present invention relates to a garment or gown constructed to decrease loss of dignity or dehumanization of people when they are admitted to a hospital, nursing home as well as other medical care centers.

BACKGROUND OF THE INVENTION

Currently known and used hospital gowns are generally of an open-back style so that when people are admitted to a hospital or medical care center, such people are forced to change their normal way of life into a role as a patient finding themselves placed in an environment over which they have minimal or if any control.

One of the first changes faced by such a person admitted to a hospital or medical care center includes the removal of clothing whereupon such person can be given a hospital gown that is opened in the back Such known hospital gowns are made of an opaque cotton or polyester cloth which per se in conjunction with the open back may not make it possible for the person or individual in the role of a patient to keep warm and also to keep himself covered to be comfortable from a warmth standpoint as well as from a standpoint of personal modesty.

Also the previously known hospital gowns have snap fasteners which can become bent or deformed such that snap fastening closure thereby is no longer possible and aside from the open back the hospital gown also remains open without being fastened by such snap fasteners which now can be eliminated and avoided entirely.

An article by Sheelagh Bramley on pages 780–781 of a British magazine "NURSING TIMES" dated June 4, 1965, concerns "Gowns - practical and pretty" in the prior art representative of at least some effort to improve existing hospital garments by making both sides identical except for provision of either buttons or button holes.

SUMMARY OF THE INVENTION

An object of the present invention is to provide a dignity gown having a minimum number of parts including a fully closed back portion as well as overlapping lower front portions and a top front portion that is capable of being detached temporarily via fastening means devoid any snap fasteners at all and provided as hook-loop fasteners known by the name "VELCRO TM" for such hook-loop fasteners as well plastic breakaway zipper means and adhesive strips to assure keeping the back side closed for warmth of a patient or individual although permitting medical examination and treatment to occur via the areas of the fastening means subject to being released or opened for limited access to upper body areas and/or lower body areas as necessary as opposed to whole body exposure previously encountered with hospital gowns.

BRIEF DESCRIPTION OF THE DRAWINGS

These and other objects and advantages of the present invention will appear more clearly from the following specification in conjunction with the accompanying schematic drawings, in which:

FIG. 1 is a plan view of a multi-part front portion of a dignity gown having features in accordance with the present invention;

FIG. 2 is a plan view of a unitary rear portion of a dignity gown having features in accordance with the present invention;

FIG. 3 is an unfolded front plan view of joined rear and front portions of the dignity gown of FIGS. 1 and 2;

DESCRIPTION OF PREFERRED EMBODIMENTS

Figure 4:
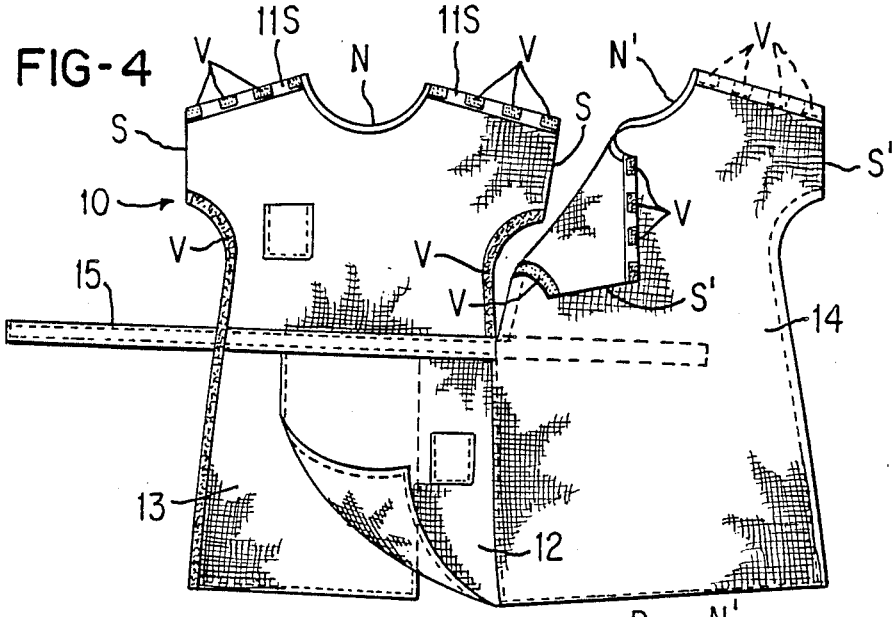
FIG. 4 is an unfolded rear plan view of joined rear and front portions of the dignity gown of FIGS. 1 and 2.
Figure 5:
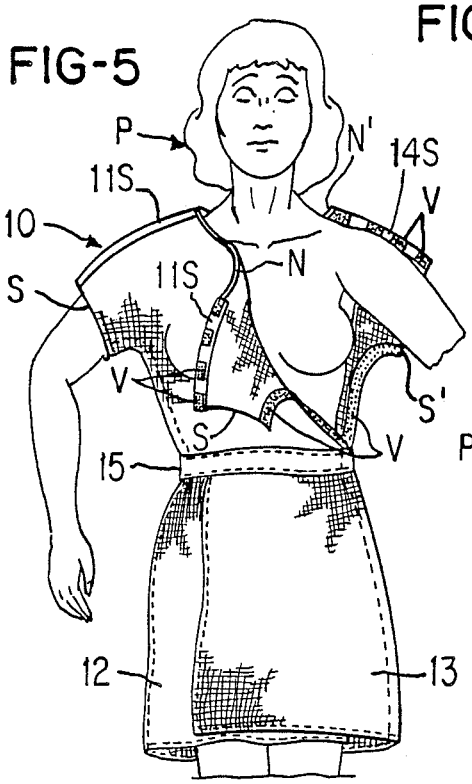
FIG. 5 is a front schematic view of the present inventive dignity gown showing only an upper left chest area exposed for examination, treatment and/or handling of a patient, with the back and front bottom portions remaining completely covered.
Figure 6:
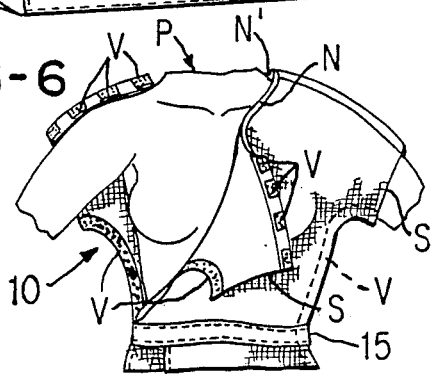
FIG. 6 is a fragmentary front schematic view of the present inventive dignity gown showing only an upper right chest area exposed for examination, treatment and/or handling of a patient with the back and front bottom portions remaining completely covered.
Figure 7:
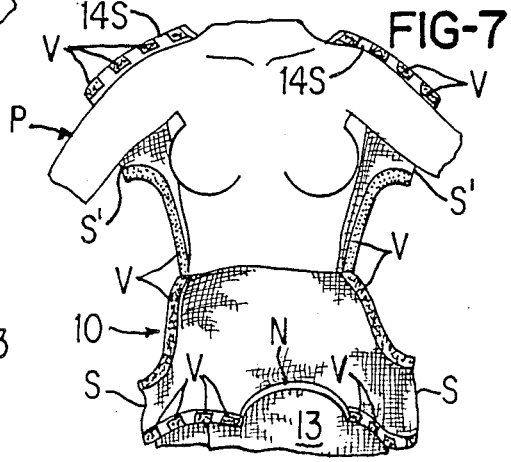
FIG. 7 is a fragmentary front schematic view of the present inventive dignity gown showing only complete right and left chest areas exposed for examination, treatment and/or handling of a patient with the back and front bottom portions remaining completely covered.
Figure 8:
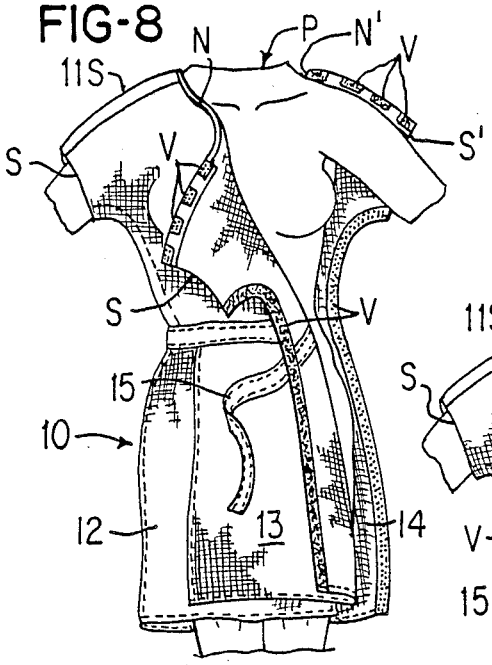
FIG. 8 is a front schematic view of the present inventive dignity gown showing both an upper left chest area and a lower left torso or trunk area exposed for examination, treatment and/or handling of the patient with the back as well as the upper and lower right bottom portions remaining completely covered.
Figure 9:
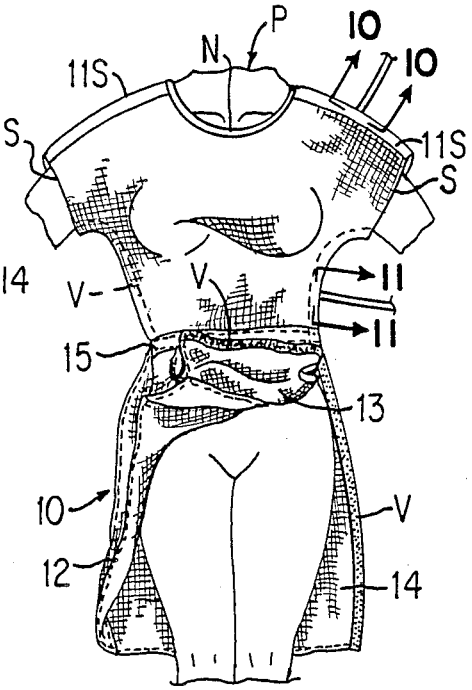
FIG. 9 is a front schematic view of the present inventive dignity gown showing the entire upper chest area entirely covered and the front bottom portions unfolded to expose the abdominal lower torso or trunk area for examination, treatment and/or handling of the patient with the back also remaining completely covered.
Figure 10:
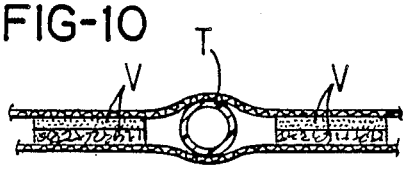
FIG. 10 is a fragmentary sectional view taken along line 10—10 in FIG. 9 to show a tube fitted to pass through the shoulder joinder areas in a gap between "VELCRO TM" fasteners.
Figure 11:
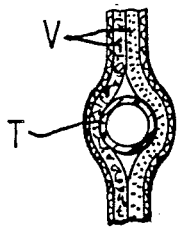
FIG. 11 is a fragmentary sectional view taken along line 11—11 in FIG. 9 to show a tube fitted to pass through the axilla or side-of-body joinder areas between "VELCRO TM" fasteners.

Referring now to the drawings in detail, FIGS. 1, 2, 3 and 4 show features of a dignity gown 10 per se and FIGS. 5, 6, 7, 8, 9, 10 and 11 show the gown or portions thereof in differing positions of functional applications.

The so-called dignity gown 10 of the present inventive disclosure provides total coverage of the trunk or body of a patient P while in a medical facility or hospital although remaining functional for examination, treatment, handling, nursing and medical procedures to be performed in behalf of the patient.

The present inventive dignity gown 10 is closed in front and also closed in back for maintaining the dignity and privacy of a patient with respect to body parts as much as possible and feasible under circumstances of examination, medical treatment and handling. The present inventive dignity gown also is longer in length than currently known gowns so as to provide coverage of the legs of a patient P when standing, sitting and lying prone on a bed or examination table.

Also the new and improved dignity gown 10 makes use of fastening means of a type identified by a "VEL- CRO TM" fastener arrangement V including eyelets and hooks interconnectable as to the eyelets as well as optionally providing plastic break away zippers as well as adhesive binders depending upon the material or fabric used for the dignity gown including for example cotton, flannel and disposable paper relative to which such adhesive strips of material or fasteners can be provided.

The completely closed back portion 14 of the dignity gown 10 has complementary thereto a front made of four portions including a top portion 11 as well as double-flap lower portion 12, 13 and a centrally located belt 15 of predetermined length which helps to hold together the top front and lower front portions sewn together along the belt 15 subject to free ends of such belt being provided to permit tying thereof with a knot or bow 15B around the waist of an individual or patient who is given such a dignity gown to wear in the medical facility or hospital during a time when the patient is being examined and/or treated.

The closed front 11, 12, 13 and closed back 14 as joined along one vertical edge and relative to the belt 15 result in a unique arrangement that makes it possible to maintain the dignity and privacy of the patient as to personal body portions and the top front panel 11 for example can be folded back by release of the fastening means such as the "VELCRO TM" fastener V, breakaway plastic zipper Z or adhesive tape fastener A so that a patient only needs to expose approximately a half of the chest area for examination as opposed to the whole or entire body being exposed when currently known gowns are worn and have to be pushed aside completely for access to the chest for examination purposes.

Also the present inventive dignity gown 10 makes it possible to expose the chest without exposing the lower body, torso or trunk of a patient at all for purposes of examination and/or treatment.

The present inventive dignity gowns 10 provide total coverage of the trunk of a patient P who is hospitalized or confined to a nursing home or health care facility. Yet the dignity gown 10 remains completely adapted for nursing and medical procedures.

There is noted that a patient, doctor, nurse or paramedic can permit the patient to keep the bottom closed but open the top or vice versa for examination and treatment purposes as apparent from the views of FIGS. 5–9 inclusive.

Also there is noted that presently known and used hospital gowns open in the back when tubes are put on a patient so that the back of the patient is cold and now the tubes need not be hooked up with the patient via the open back area but rather the tubes T, T' can be fitted through suitable passages in the dignity gown such that the tubes are positioned to pass in a location where the "VELCRO TM" fastening means, adhesive tape fastening means or even plastic breakaway zipper means can be opened in a very limited or localized area of shoulder edges 11*s*, 14*s* of the front and back 11, 14 on opposite edges of a cut-out neck portion N, N' respectively provided with "VELCRO TM" fasteners V capable of being fastened.

The adhesive tape with paper throw away gowns having the arrangement of a single closed and full back 14 as well as the four-part front including the top portion 11, and belt 15 overlap lower portions 12, 13 of the front can avoid discomfort or coldness of the patient as to his back body portion.

The "VELCRO TM" fastening means V if used with a cotton or flannel material or fabric can collect lint whereas the zippers would be free of any lint accumulation.

The top front panel 11 of the dignity gown 10 for example can be provided with an optional pocket for holding a monitor halter or personal belonging of the patient when confined to a hospital or medical treatment center.

The belt 15 provided with the three front panels including the top 11 and two lower panels 12, 13 makes possible a joinder of these front portions as divided by the location of the belt 15 plus at the same time the belt 15 permits holding together the front portions 11, 12, 13 and back portion 14 together with the possibility of tieing the free ends of the belt into a knot or bow 15B as feasible according to FIG. 2 with the particular size of the patient or individual involved when using the particular dignity gown 10 in accordance with the present invention.

Also the dignity gown of the present invention can be used by disabled people allowing the disabled person to be only partially exposed during examinations, procedures and treatments without having to be totally exposed during such necessary procedure.

The gown of the present invention is constructed to decrease the loss of dignity and dehumanization of people when they are admitted to a hospital. As indicated, such individuals or patients are forced to change from their normal role of keeping their body parts covered and they are placed in an environment over which they have minimal if any control with respect to exposure of their body unnecessarily to open air or becoming cold as well as being seen unnecessarily.

The dignity gowns can be constructed with a middle weight flannel cloth which provides a soft warm feeling for the patient or individual.

The dignity gown has a solid back 14 that is cut from a bolt of cloth which is three yards or approximately thirty-six inches wide for example. The measurements for the back 14 of the dignity gown 10 are taken from the outer tip of the sleeve across the nape or back of the neck collar region N, N' to the outer tip of the opposite sleeve S, S' for a distance of approximately thirty-three inches.

In the area of the axilla or under arm portion of a torso or body of an individual there is noted that the side to side measurement of the dignity gown is approximately twenty-four inches. The side to side measurement at the waist is also twenty-four inches across. The hem of the gown measures at substantially twentY-nine inches side to side. The overall length of the collar opening to the hem is approximately forty-four inches.

The waistband or belt, sewn to the lower edge of the top portion of the front as well as the top edge of the overlapping flap portions of the bottom of the dignity, can be provided in a range encompassing a minimum of twenty-four inches long and up to forty-eight inches long to permit wrapping of the belt around a torso of an individual subject to tieing a knot or bow with the free ends of the waistband or belt that is substantially one and three fourths inches wide.

The dignity gown has a cloth flap 12 attached along a right side R thereof that goes from the side toward the middle of the gown and is twenty-one inches wide and twenty-two inches long so that an overlapping relationship of the front cloth flaps for the lower portion of the dignity gown allows people to sit down without exposing themselves and keeping the legs of the individual covered as much as possible.

The front bottom 11, 12 of the gown measures twenty-four inches wide where it is attached to the waistband or belt and this front portion of the gown flares out to twenty-nine inches wide at the hem line and is twenty-two inches long in the height direction.

A total length of the front including top and bottom portions is also forty-four inches which is a length that is approximately three inches longer than the currently known hospital gowns.

Each sleeve portion S, S' respectively of the front and back portions of the dignity gown can be provided with a fastener means of interlocking hook-eyelet portions at the tip and collar of the sleeve making it possible for each piece of "VELCRO TM" fastening means V to hold the front and back sleeve portions S, S' together. The so-called eyelet or soft portion of the "VELCRO TM" fastener means V is fastened to the closed or solid back portion, 14 of the dignity and the barbed complementary "VELCRO TM" fastener means is secured to the top front portion 11 and lower front panel portions 12, 13 of the dignity gown for example along a left side edge L extending from top to bottom of the dignity gown 10.

This "VELCRO TM" fastening means V used over the length of the right or left side of the gown as the case may be is approximately three fourths of inch wide and thirty-seven inches long and starts at the axilla or under arm region and goes to the hem H, H' respectively along the bottom edge of the front portions 12, 13 and back portion 14 of the dignity gown 10.

The opposite left or right side of the "VELCRO TM" fastening means extends from the axilla or under arm region only to the waist measuring for a distance approximately twenty-two inches in length from the waistband or belt as to the hip region the gown is sewn together.

This arrangement allows the patient or individual to be only partially exposed during examination, procedures and treatments or only if necessary being more fully exposed as required by medical procedures and treatments.

A dignity gown 10 is for people admitted to a hospital, nursing home, medical care facility and the like for privacy and convenience of a patient and medical personnel. The gown has a fully closed back portion 14 as well as a top front portion 11 and a lower or bottom front portion with overlapping flaps 12, 13 subject to intermediate location of a fastening band or belt 15 secured to the top front portion and bottom front portion at a substantially horizontal juncture thereof subject to fastening means such as "VELCRO TM" hook and loop interlocking barb and eyelet configurations doing away completely with any snap fasteners and to include an adhesive strip as well as plastic breakaway zipper construction secured along the sleeve and shoulder areas as well as along an axilla of one side of the juncture of the completely closed back portion 14 and foldable front top portion 11 and foldable front bottom portions having overlapping flaps 12, 13. The front top portion 11 is releasable as to the fastening thereof along the sleeve S, S' and shoulder areas **11*s*, 14*s* as well as along the axilla area for exposure up to a minimum of half a breast or chest area of a patient and optionally to allow examination of full chest area without exposing the bottom trunk or torso area of a patient and vice versa. The dignity gown 10 has a minimum number of back and front portions 14, 12, 13** respectively although affording access for medical examination and treatment as needed while preserving the privacy and dignity of a patient as well as ensuring the warmth and protective covering of the back of the patient otherwise exposed to cold air and visibility to others in the medical facility or hospital.

In conclusion, the dignity gown 10 of the present invention provides total coverage of the trunk or torso of a body of a patient or individual while in a hospital, medical center, nursing home or other health facility.

The dignity gown 10 having the features of the present invention can be considered to be good not only for the patient or individual wearing such dignity gown but also good for doctors and nurses who must perform examinations and other medical procedures including the installation of test tubes T, T' which are capable of being placed and located to extend in and out from underneath the gown as to the trunk or body and torso regions of a patient with space being available to come in and out relative to the locations of the "VELCRO TM" fastening means V, adhesive strip fastening means A and optionally plastic breakaway zipper means Z.

The multiple purpose mid-section band or belt 15 makes a division between the front top portion 11 and lower double panel bottom portion 12, 13 of the dignity gown plus serving to hold together the top and bottom portions in the front of the dignity gown 10 subject to opening of the "VELCRO TM" hook-eyelet fasteners V along one vertically joinable edge R of the front and bottom as well as back portions.

The present invention is, of course, in no way restricted to the specific disclosure of the specification and drawings, but also encompasses any modifications within the scope of the appended claims.

What we claim is:

1. A dignity gown which provides total coverage of a trunk and torso of a patient while in a hospital, convalescent center, medical treatment facility and the like although remaining functional for nursing and medical procedures to be performed as to body portions of a patient as may be needed, comprising:

an openable front of the gown consisting of in essence a top front portion as well as overlapping lower front flap panel portions as well as a band permanently joined to the front top and bottom portions transversely at an intermediate location thereof;

a completely closed back portion unitary from top to bottom and secured along one side thereof in a predetermined fastening to at least one of said lower front panel portions; and fastening means along sleeve and shoulder areas of front and back portions as well as along a side opposite to that joined to said at least one of said lower front panel portions, said fastening means permitting partial removal and at least in part folding open of the top front portion if necessary independently of the lower front portion so that a patient only needs to expose a minimum of half of the chest area for examination as opposed to the entire or whole body exposure previously encountered as well as exposure of the complete chest area for examination while the bottom front portion of the trunk and torso of the body of a patient can be kept covered and vice versa as may be needed for examination and treatment of the patient in a medical facility; and said lower front portion being also removable and at least in part foldable open during examination and medical treatment by folding open thereof and detachment of the fastening means as to each other.

2. A gown according to claim 1, in which said fastening means is a reusable closure which can be subjected to washing and cleaning operation as to the gown material.

3. A gown according to claim 2, in which said fastening means is a soft eyelet fastener secured to the back portion and a barbed portion complementary to the eyelet portion designated as "VELCRO TM" fastening means.

4. A gown according to claim 2, in which said fastening means is a plastic breakaway zipper having complementary teeth usable for fastening purposes again and again and also capable of withstanding repeated washing and cleaning thereof.

5. A gown according to claim 2, in which said complete and full back portion as well as the top front portion and bottom overlapping flap panel portions consist of cotton.

6. A gown according to claim 2, in which said back portion as well as said front top portion and bottom overlapping flap panel portions consist of disposable paper.

7. A gown according to claim 6, in which an adhesive strip is provided for fastening purposes along the sleeve, shoulder and side areas of the gown.

8. A gown according to claim 2, in which a pocket is provided as to at least one of the top front and front bottom flap panel portions to hold monitor means or personal belongings of a patient.

9. A gown according to claim 2, in which said tape portion located intermediate the top front portion and bottom front overlapping flap panel portions is extended to have free ends forming a belt capable of being tied in a bow as well as knot around the mid section of a patient.

10. A gown according to claim 1, in which said fastening means is capable of being opened to a limited extent to permit passage of chest tubes in and out as to the shoulder, sleeve, and axilla areas of the gown.

* * * * *